US005476153A

United States Patent [19]

Dickerson et al.

[11] Patent Number: 5,476,153

[45] Date of Patent: Dec. 19, 1995

[54] LADDER LEVELING APPARATUS

[76] Inventors: Craig A. Dickerson; Julie R. Dickerson, both of 4855 SW. 98th St., Beaverton, Oreg. 97005

[21] Appl. No.: 217,560

[22] Filed: Mar. 25, 1994

[51] Int. Cl.[6] ..... E06C 7/00

[52] U.S. Cl. ..... 182/204; 182/108

[58] Field of Search ..... 182/204, 205, 182/201, 202, 203, 108, 214

[56] References Cited

U.S. PATENT DOCUMENTS

| | | | |
|---|---|---|---|
| 898,973 | 9/1908 | Curran | 182/205 |
| 970,425 | 9/1910 | Curran | 182/205 |
| 971,997 | 10/1910 | Henning | 182/205 |
| 1,376,777 | 5/1921 | O'Connor | 182/205 |
| 2,147,052 | 2/1939 | Noone | 182/205 |
| 3,527,321 | 9/1970 | Brown | 182/205 |
| 3,948,352 | 4/1976 | Larson et al. | 182/204 |
| 4,423,797 | 1/1984 | Batten | 182/204 |
| 4,606,432 | 8/1986 | Belt | 182/204 |
| 4,607,726 | 8/1986 | Davis et al. | 182/204 |
| 4,802,471 | 2/1989 | Cordell | 182/204 |

FOREIGN PATENT DOCUMENTS

| | | | |
|---|---|---|---|
| 112531 | 2/1941 | Australia | 182/204 |
| 1554684 | 2/1970 | Germany | 182/201 |
| 516447 | 2/1955 | Italy | 182/205 |

*Primary Examiner*—Karen J. Chotkowski

*Attorney, Agent, or Firm*—David L. Baker; Henry S. Miller; Rhodes & Ascolillo

[57] ABSTRACT

An apparatus for leveling a ladder having at least two vertical supports has a vertical support gripping member that has a support wall and a gripping wall attached to the support wall. A plurality of gripping wall teeth is on the gripping wall. A tightening member wall is attached to the support wall and opposes the gripping wall. A first vertical support retaining member is attached to the gripping wall. A second vertical support retaining member is attached to the tightening member wall. The guide channel is formed by the support wall, the gripping wall, the tightening member wall, the first vertical support retaining member and the second vertical support retaining member. One of the vertical support members is slidingly engaged within the guide channel. A threadingly adjustable tightening member, threadingly engaged in a threaded port in the vertical support, releasingly abuts a first outer surface of one of the vertical supports. There is a plurality of vertical support wall teeth on a second outer wall of the vertical supports. The vertical support wall teeth releasably interface with the gripping wall teeth.

4 Claims, 2 Drawing Sheets

LADDER LEVELING APPARATUS

BACKGROUND OF THE INVENTION

1. Field of the Invention

This invention relates to an apparatus for leveling a ladder when in use on uneven terrain.

2. Description of the Related Art

Many attempts have been made to provide a ladder user with more stability when the ladder had to be placed on uneven terrain.

U.S. Pat. No. 3,948,352 to C. E. Larson, et al., on Apr. 06, 1976 for an Extension Ladder with Ladder Leveler Means describes a spring-biased pin member that protrudes into a plurality of spaced-apart holes thereby locking the two sections of the extension ladder together.

U.S. Pat. No. 4,423,797 to L. E. Batten on Jan. 03, 1984 for a Ladder Leveling Device shows a hollow leveler guide (attached to a ladder leg) with a leveler leg placed therein. The guide and leg have holes in them that can be aligned and a pin inserted through the holes to lock the leveler leg in place.

U.S. Pat. No. 4,606,432 to N. W. Belt on Aug. 19, 1986 for an Adjustable Ladder Leg describes a leveling leg slidingly engaged within a hollow guide channel which is clamped to a ladder leg. There is a spring-loaded pin that engages a plurality of pin holes to lock the leveling leg to the guide channel.

U.S. Pat. No. 4,607,726 to R. J. Davis, et al., on Aug. 26 1986 for a Ladder Extension shows a hollow sleeve member with an extension member slidingly placed therein. The sleeve member has brackets to attach the sleeve member to the legs of the ladder. A retaining pin is placed within directly opposing holes in the sleeve member and the extension to lock the two members in a selected position.

U.S. Pat. No. 4,802,471 to J. E. Cordell on Feb. 07, 1989 for a Leveler Attachment for Ladders describes a hollow beam that is bolted to a leg of a ladder. A bar slides within the hollow beam. A spring-biased gripping lever, attached to the hollow beam, has a sharp edge that grips a surface of the hollow beam keeping the bar extended and in place to level the ladder.

All the above devices involve attaching a hollow sleeve to a leg of the ladder and providing a bar to slide within the sleeve and securing the bar to the sleeve in some manner. The present invention involves utilizing the support legs of the ladder itself in a novel manner reducing the number of additional parts to encumber the ladder. This allows the user to be able to purchase a ladder for use in uneven terrain and not have to tie up valuable time to modify the ladder.

SUMMARY OF THE INVENTION

One of the problems that a user of a ladder encounters is how to place a ladder in a stable position when it must be placed on an uneven surface such as a hillside. Typically the ladder user has to place bricks or boards under at least one of the legs of the ladder to place the ladder in a stable position. If the bricks or boards slip from under the legs of the ladder, a potentially dangerous situation could arise.

In one aspect of the present invention, an apparatus for leveling a ladder having at least two vertical supports is shown. The apparatus has a vertical support gripping member. The vertical support gripping member has a support wall and a gripping wall attached to the support wall. A tightening member wall is attached to the support wall and opposes the gripping wall. A guide channel is formed by the support wall, the gripping wall and the tightening member wall. One of the vertical support members is slidingly engaged within the guide channel. There is a threadingly adjustable tightening member, threadingly engaged in a threaded port in the vertical support, that releasingly abuts a first outer surface of one of the vertical supports. There is a plurality of vertical support wall teeth on a second outer surface of the vertical supports. The vertical support wall teeth releasably interface with the gripping wall.

In a second aspect of the present invention an apparatus for leveling a ladder having at least two vertical supports is shown. The apparatus has a vertical support gripping member. The vertical support gripping member has a support wall and a gripping wall attached to the support wall. The tightening member wall is attached to the support wall and opposes the gripping wall. There is a first vertical support retaining member attached to the gripping wall. A second vertical support retaining member is attached to the tightening member wall. There is a guide channel formed by the support wall, the gripping wall, the tightening member wall, the first vertical support retaining member and the second vertical support retaining member. One of the vertical support members is slidingly engaged within the guide channel. A threadingly adjustable tightening member is threadingly engaged in a threaded port in the vertical support gripping member and releasingly abuts a first outer surface of the vertical supports. There is a plurality of vertical support wall teeth on a second outer surface of the vertical supports. The vertical support wall teeth releasably interface with the gripping wall.

It is an object of this invention to provide an extension apparatus for each vertical support leg of a ladder so that the ladder may be used on uneven surfaces and provide more stability than a ladder without a means of adjusting the length of the legs of the ladder.

DESCRIPTION OF THE PREFERRED EMBODIMENTS

Figure 1:
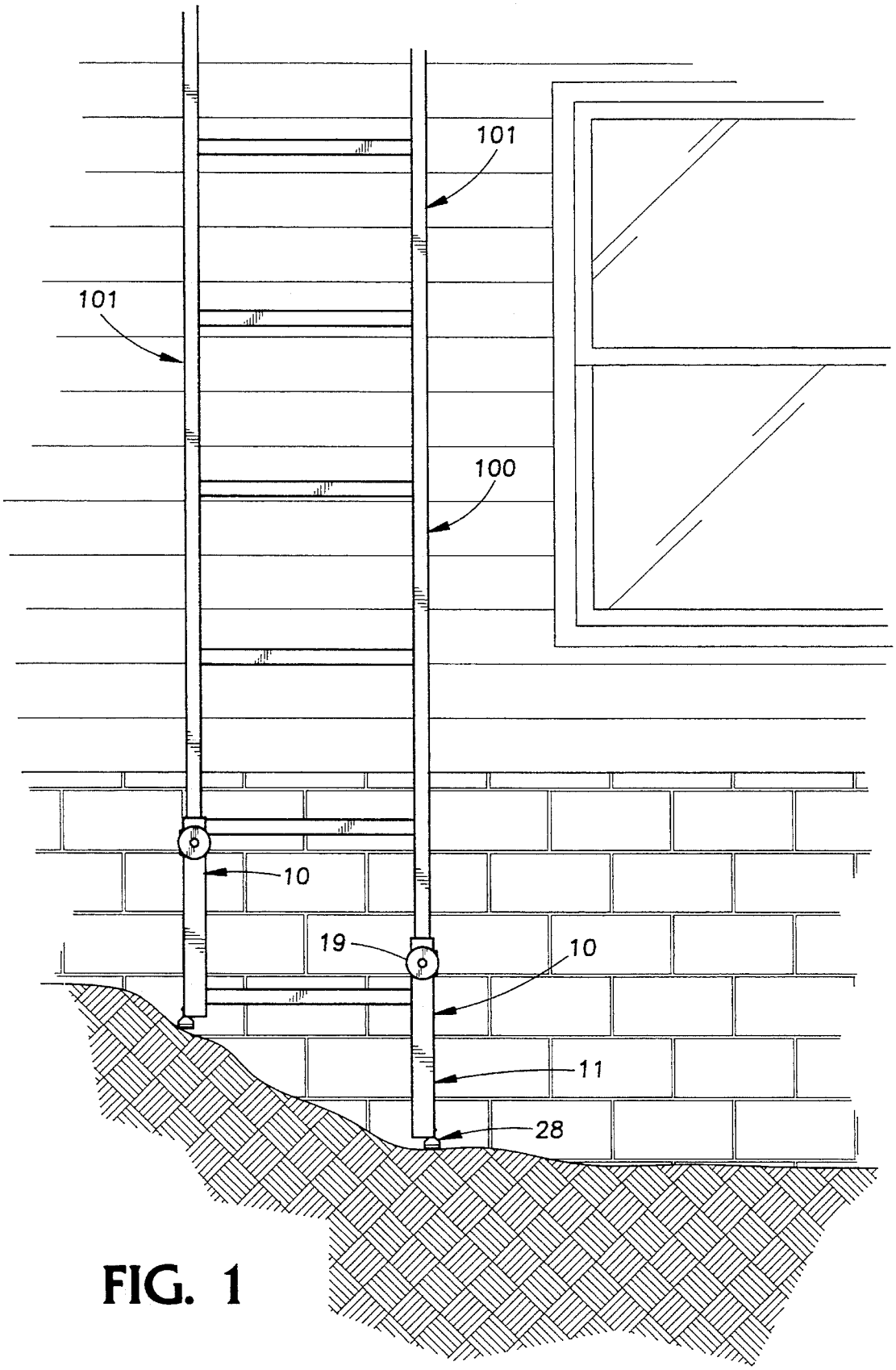
FIG. 1 is an environmental front elevational view of the Ladder Leveling Apparatus shown leaning on a structure and resting on an uneven ground surface.
Figure 2:
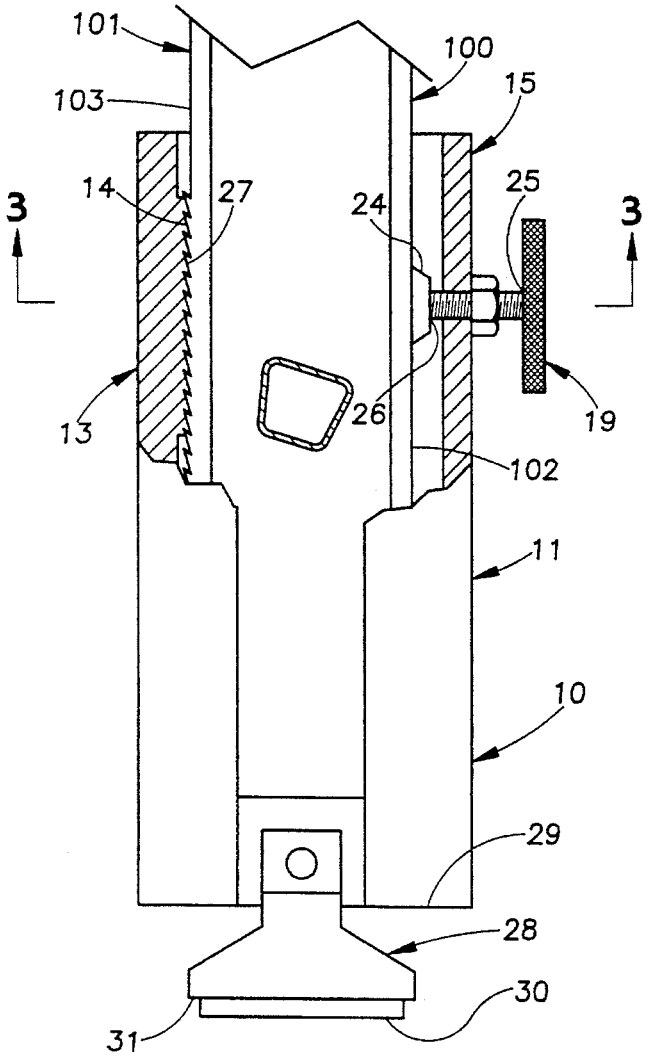
FIG. 2 is an enlarged cut-away right side elevational view of the ladder leveling apparatus on a partial view of a ladder leg.
Figure 3:
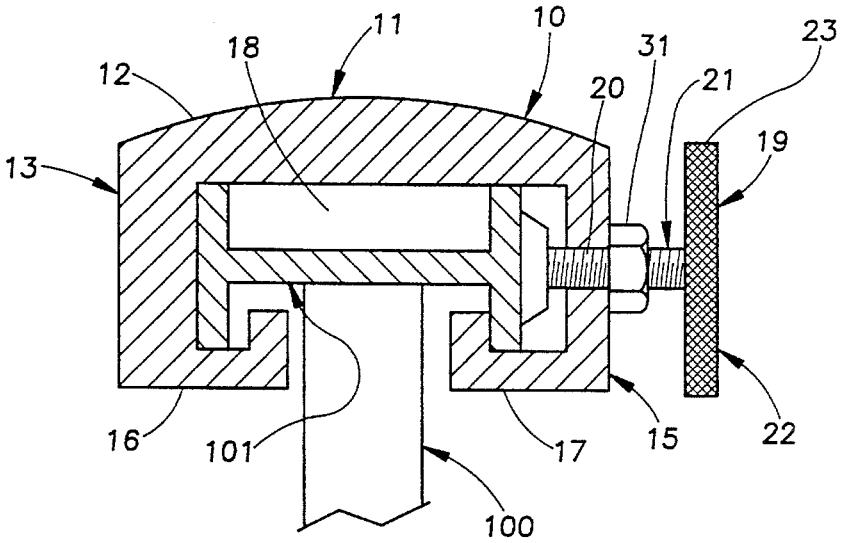
FIG. 3 is a cross-sectional view taken along line 3—3 of FIG. 3.

Referring to FIGS. 1 through 3, an apparatus 10 for leveling a ladder 100 having at least two vertical supports 101 is shown and described. The apparatus 10 has a vertical support gripping member 11 having a support wall 12 and a gripping wall 13 attached to the support wall 12. There is a plurality of gripping wall teeth 14 on the gripping wall 13. A tightening member wall 15 is attached to the support wall 12 and opposes the gripping wall 13. A first vertical support retaining member 16 is attached to the gripping wall 13. There is a second vertical support retaining member 17 attached to the tightening member wall 15.

The guide channel 18 is formed by the support wall 12, the gripping wall 13, the tightening member wall 15, the first vertical support retaining member 16 and the second vertical support retaining member 17. One of the vertical support members 101 is slidingly engaged within the guide channel 18.

A threadingly adjustable tightening member 19, threadingly engaged in a threaded port 20 in the vertical support gripping member 11, releasingly abuts a first outer surface 102 of one of the vertical supports 101. The tightening member 19 has a threaded shaft 21 with a knob 22, having a knurled surface 23 thereon, attached to an end 25 of the shaft 21 and an abutment plate 24 attached to another end 26 of the shaft 21. There is a lock nut 31 on shaft 21. Shaft 21 is a threaded bolt. Lock nut 31 secures shaft 21 in place when tightened. The abutment plate 24 could be pivotally attached to the another end 26. The abutment plate 24 abuts the first outer surface 102 of the vertical support 101. There is a plurality of vertical support wall teeth 27 on a second outer wall 103 of the vertical supports 101. The vertical support wall teeth 27 releasably interface with the gripping wall teeth 14. There may be a foot 28 pivotally connected to the distal end 29 of the vertical support gripping member 11. The foot 28 may have a resilient pad 30 attached to the distal end 31 of the foot 28 to reduce slippage.

In operation, the vertical support wall teeth 27 are usually made part of the second outer surface 103 of the vertical supports 101 at the time the ladder 100 is manufactured. The teeth 27 on the second outer surface 103 could be riveted, bolted, cast, cut, drawn, welded or adhered to the vertical supports (legs) 101 of the ladder 100. The teeth 14 of the gripping wall 13 could be attached in a similar manner. The rest of the vertical support gripping member 11 could be made in any manner known to one skilled in the art. The slope of the gripping wall teeth 14 will be directed as shown in FIG. 2 in one direction and the slope of the vertical support wall teeth 27 will be directed in a position to engage the teeth 14 of the gripping wall 13 and remain in position when the tightening member 19 pushes the second outer surface 103 of the vertical support 101 with its teeth 27 thereon against the teeth 14 of the gripping wall 13. When the tightening member 19 is loosened and the teeth 27 on the second outer surface 103 of the vertical support 101 disengages from the teeth 14 of the gripping wall 13, the vertical support gripping member 11 on either vertical support 101 can be raised or lowered to a new position.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

We claim:

1. An apparatus for leveling a ladder having at least two vertical supports, the apparatus comprising:

(a) a vertical support gripping member comprising:

a support wall;

a gripping wall attached to the support wall;

a tightening member wall attached to the support wall and opposing the gripping wall;

a guide channel formed by the support wall, the gripping wall and the tightening member wall;

one of the vertical support members slidingly engaged within the guide channel; and a threadingly adjustable tightening member, threadingly engaged in a threaded port in the vertical support gripping member, releasingly abutting a first outer surface of the vertical supports;

the tightening member comprising:

an abutment plate;

a threaded bolt having one end pivotally attached to the abutment plate;

a locking nut on the threaded bolt;

a gripping knob attached to another end of the threaded bolt; and a knurled surface on the gripping knob;

(b) a plurality of vertical support wall teeth on a second outer surface of the vertical supports; and (c) the vertical support wall teeth releasably interfacing with the gripping wall.

2. An apparatus for leveling a ladder having at least two vertical supports, the apparatus comprising:

(a) a vertical support gripping member comprising:

a support wall;

a gripping wall attached to the support wall;

a tightening member wall attached to the support wall and opposing the gripping wall;

a first vertical support retaining member attached to the gripping wall;

a second vertical support retaining member attached to the tightening member wall;

a guide channel formed by the support wall, the gripping wall, the tightening member wall, the first vertical support retaining member and the second vertical support retaining member;

one of the vertical support members slidingly engaged within the guide channel; and a threadingly adjustable tightening member, threadingly engaged in a threaded port in the vertical support gripping member, releasingly abutting a first outer surface of the vertical supports;

the tightening member comprising:

an abutment plate;

a threaded bolt having one end pivotally attached to the abutment plate;

a locking nut on the threaded bolt;

a gripping knob attached to another end of the threaded bolt; and a knurled surface on the gripping knob;

(b) a plurality of vertical support wall teeth on a second outer surface of the vertical supports; and (c) the vertical support wall teeth releasably interfacing with the gripping wall.

3. An apparatus for leveling a ladder having at least two vertical supports, the apparatus comprising:

(a) a vertical support gripping member comprising:

a support wall;

a gripping wall attached to the support wall;

a plurality of gripping wall teeth on the gripping wall;

a tightening member wall attached to the support wall and opposing the gripping wall;

a first vertical support retaining member attached to the gripping wall;

a second vertical support retaining member attached to the tightening member wall;

a guide channel formed by the support wall, the gripping wall, the tightening member wall, the first vertical support retaining member and the second vertical support retaining member;

one of the vertical support members slidingly engaged within the guide channel; and a threadingly adjustable tightening member, threadingly engaged in a threaded port in the vertical support gripping member, releasingly abutting a first outer surface of the vertical supports;

the tightening member comprising:

an abutment plate;

a threaded bolt having one end pivotally attached to the abutment plate;

a locking nut on the threaded bolt;

a gripping knob attached to another end of the threaded bolt; and a knurled surface on the gripping knob:

(b) a plurality of vertical support wall teeth on a second outer wall of the vertical supports; and (c) the vertical support wall teeth releasably interfacing with the gripping wall teeth.

4. An apparatus as described in claim 3 further comprising:

(a) a foot pivotally connected to the distal end of the vertical support gripping member;

(b) a resilient pad attached to the distal end of the foot.

* * * * *